United States Patent [19]

Speck et al.

[11] 4,043,295

[45] Aug. 23, 1977

[54] APPARATUS FOR SPRAY-COATING INTERNAL SURFACES OF TUBULAR ARTICLES

[75] Inventors: Reinhold Speck; Stefan Forberger, both of Singen, Germany

[73] Assignee: Georg Fischer Aktiengesellschaft, Schaffhausen, Switzerland

[21] Appl. No.: 595,500

[22] Filed: July 14, 1975

[30] Foreign Application Priority Data

July 22, 1974 Switzerland ..... 10050/74

[51] Int. Cl.[2] ..... B05B 13/06

[52] U.S. Cl. ..... 118/317; 239/434

[58] Field of Search ..... 118/55, 105, 214, 254, 118/317, 318, 408, 416; 239/433, 434

[56] References Cited

U.S. PATENT DOCUMENTS

| | | | |
|---|---|---|---|
| 1,956,637 | 5/1934 | Biggs et al. | 118/317 X |
| 2,083,851 | 6/1937 | Marcy | 239/433 X |
| 2,532,851 | 12/1950 | Meyer | 239/434 X |
| 2,858,797 | 11/1958 | Levin | 118/317 |
| 3,013,528 | 12/1961 | Bland | 118/317 X |
| 3,143,294 | 8/1964 | Lundin et al. | 239/434 X |
| 3,595,482 | 7/1971 | Loveday | 239/434 X |

*Primary Examiner*—Louis K. Rimrodt
*Attorney, Agent, or Firm*—William R. Woodward

[57] ABSTRACT

A coating liquid is squirted through a needle control nozzle directed into open end of internal threads of a fitting or tube and is deflected radially to form a spray cone by an air jet from a revolving nozzle set slightly in front and off the axis of the nozzle for the coating liquid. An end plate affixed to the revolving nozzle limits the forward spread of the spray cone, so that the coating thickness taper is cut off at the inner end of the coating on the threads. The thickness taper produced at the outer end of the threads by the spray cone favors easy engagement of the threads in making a tight threaded joint.

3 Claims, 3 Drawing Figures

APPARATUS FOR SPRAY-COATING INTERNAL SURFACES OF TUBULAR ARTICLES

This invention relates to a method and apparatus for applying a coating material to the internal threads of pipes and fittings, by spraying on a liquid coating material by means of an air jet.

For coating the internal threads of pipes or fittings for the provision of sealing material on parts to be screwed together into gas-tight and liquid-tight joints, it is known to paint on the coating material with application tools, to project or squirt it on by means of rotary distributing tools or to spray on the coating material with compressed-air-driven spraying tools or nozzles.

From the disclosure of German published Pat. application (OS) No. 2,002,902 it is known to apply adhesive to pipe ends by the use of a nozzle that centers itself in the pipe and which is provided with a large number of perforations distributed over its circumference and to connect to the nozzle a commercially available application gun driven by compressed air. There is the disadvantage in this arrangement that a new nozzle must be provided for each different pipe diameter to be coated, for different layer thicknesses and for every different length of coating. Furthermore, the coating of inside threads of a pipe end is not possible with this device.

U.S. Pat. No. 3,516,385 shows an apparatus in which the coating of inside walls of tubes is carried out with a rotating distributor tool. The coating material is brought into the rotating chamber of the distributor tool through a fixed feed channel and it is applied to the inner wall of the tube or pipe to be coated through circumferential openings, by the effect of centrifugal force. For viscous liquid coating materials and for small diameters of the tube to be coated, this device is unsuitable because the speeds of rotation then required are too great.

It is the object of the present invention to provide a method and apparatus for coating the internal threads of pipes and fittings that is suitable even for small inner diameters of threading and by which a short operating cycle, making possible a high output per hour, can be obtained and, furthermore, to provide the necessary apparatus at low manufacturing costs and with an automatic, reliable and economic manner of operation.

SUBJECT MATTER OF THE PRESENT INVENTION

Briefly, a jet of coating material is directed in the axial direction into the work piece and is subjected to the action of an air jet operating at right angles to the liquid coating material jet at a location just in front of the nozzle that forms the coating material jet, the air jet nozzle being radially offset and caused to revolve around the axis of the coating material jet, so as to create a revolving spray cone of coating material spray directed radially against the internal threading to be coated.

An end plate, preferably in the shape of a disk, is provided beyond the path of travel of the air jet to limit the spray cone and if desired the end plate is made readily removable and replaceable by an end plate of different diameter so that the end plate used can always be only slightly smaller than the inside diameter of the work piece to be coated.

In a particular form of the invention, an axially actuatable control needle is provided for the liquid coating material nozzle and its range of actuation is preferably made adjustable for adjustment of the rate of material feed.

The invention is further described by way of illustrative example with reference to the accompanying drawings, in which.

Figure 1:
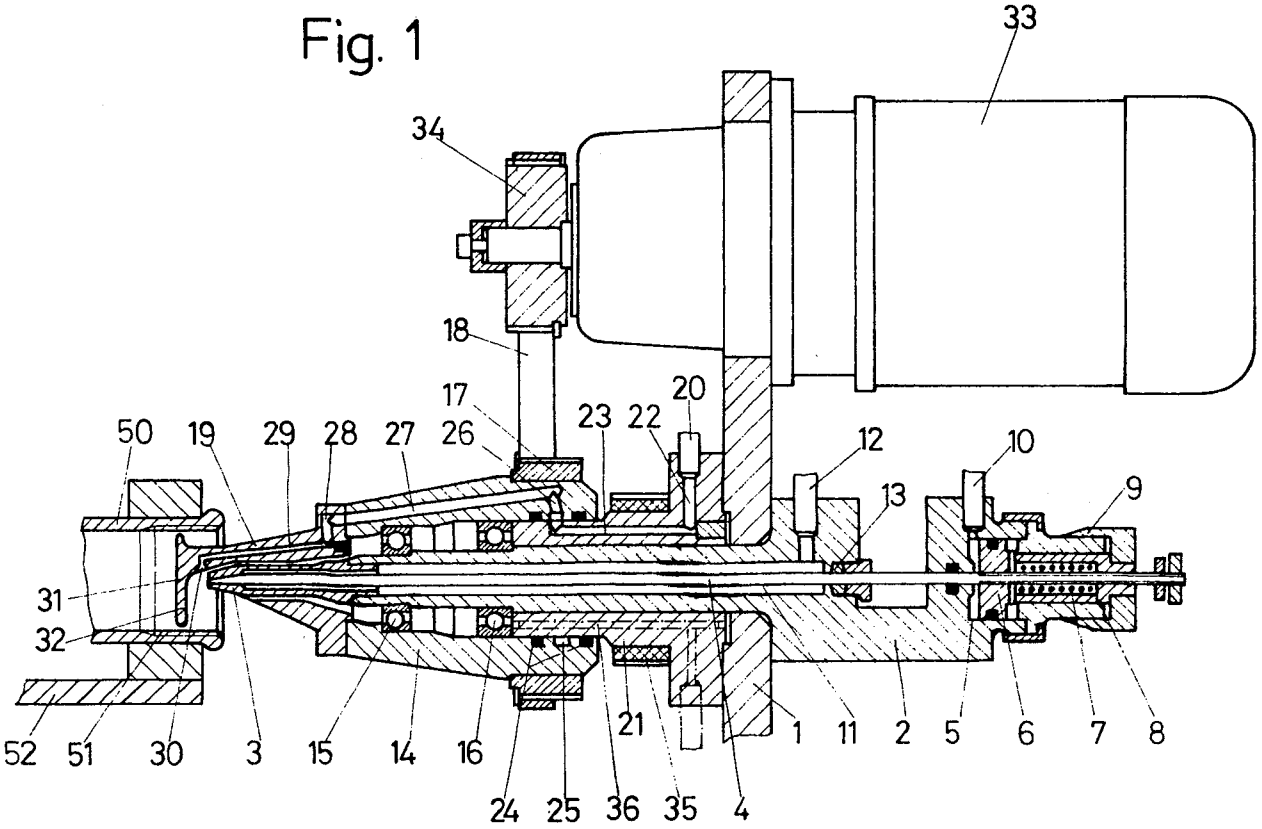
FIG. 1 is a longitudinal section of an apparatus for coating the inside of tubular articles.

The apparatus shown in FIG. 1 by way of example is an embodiment of the invention usuable for coating the inner threads of an inside-threaded tubular article. As there shown, a carrier plate 1 is mounted transversely on a gun-type body 2 on the forward end of which an interchangeable nozzle 3 for the coating material is mounted.

A needle control 4 is mounted on the axis of the "barrel" of the gun body 2 to serve as a nozzle closure valve. The control needle 4 extends back into the cylinder 5, where it is provided with the piston 6 that is subjected on one side to a pressure medium, for example compressed air, and on the other side to the force of a spring 7 against which the compressed air works to actuate the needle 4. An adjustment spindle 8 provided with a scale ring 9 determines the extent to which the needle may be withdrawn from the nozzle 3 to open the nozzle when compressed air is applied to the piston 6 (the adjustment thus controlling the length of the needle valve actuation stroke).

Figure 3:
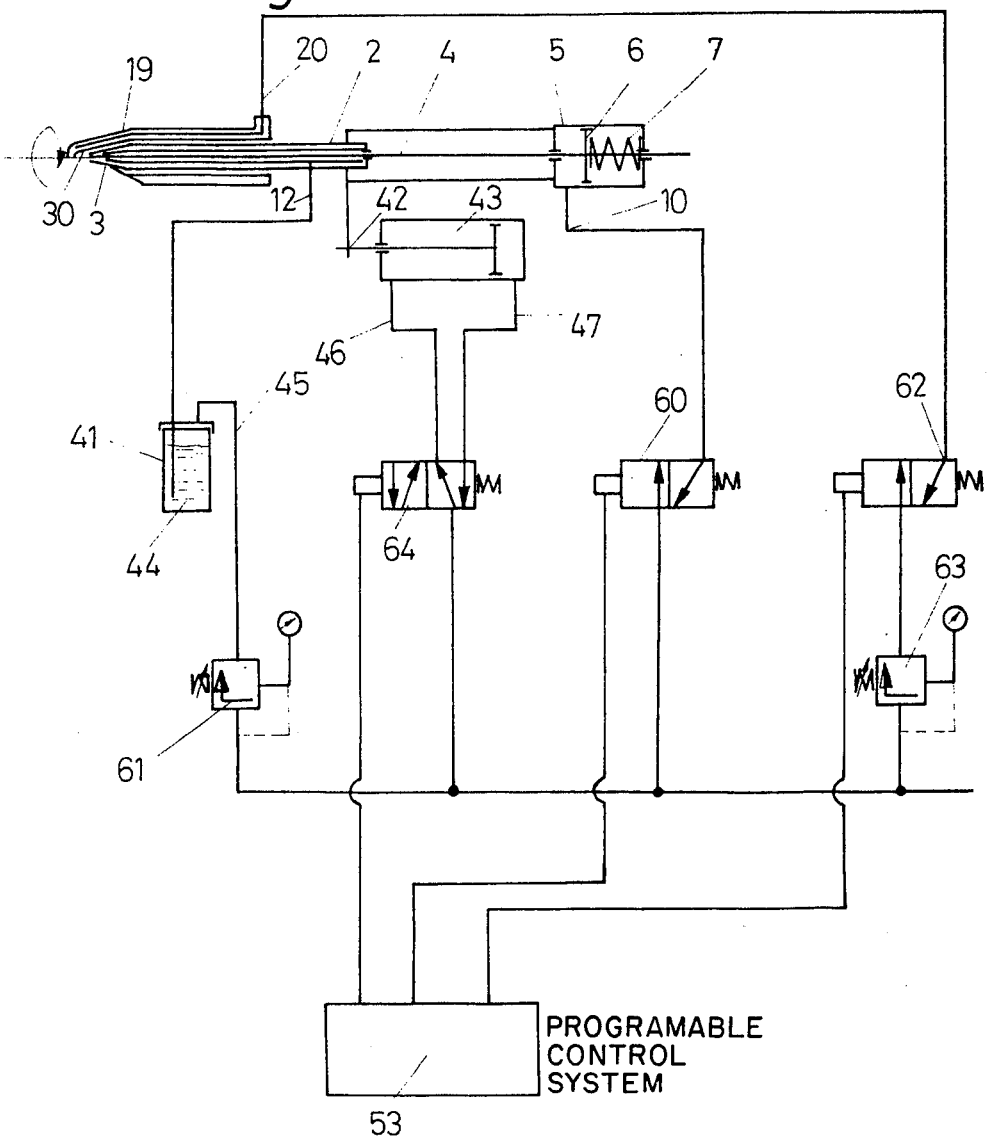
FIG. 3 is a diagram of a control system for the apparatus of FIG. 1.

The supply of compressed air for the piston 6 is provided by the connecting flexible tube 10 which leads from a magnetic control valve 60 (shown in FIG. 3) where the compressed air supply for the nozzle is controlled.

The nozzle control needle 4 and the central bore in the "barrel" portion of the gun body 2 form the axially elongated annular cavity 11 into which is fed the coating material, which comes from a supply container 41 (shown in FIG. 3) under pressure through the flexible conduit 12. From the annular cavity 11 the coating material proceeds to The nozzle 3. The pressure in the supply container 41 is produced by air pressure operating against the coating material supply 44 in the container, this air pressure being adjustable by the valve 61 interposed in the compressed air line 45 (see FIG. 3). The bushing seal 13 in the gun body 2 prevents the leaking out of coating material from the back of the cavity 11 where the control needle passes through the cavity wall.

Figure 2:
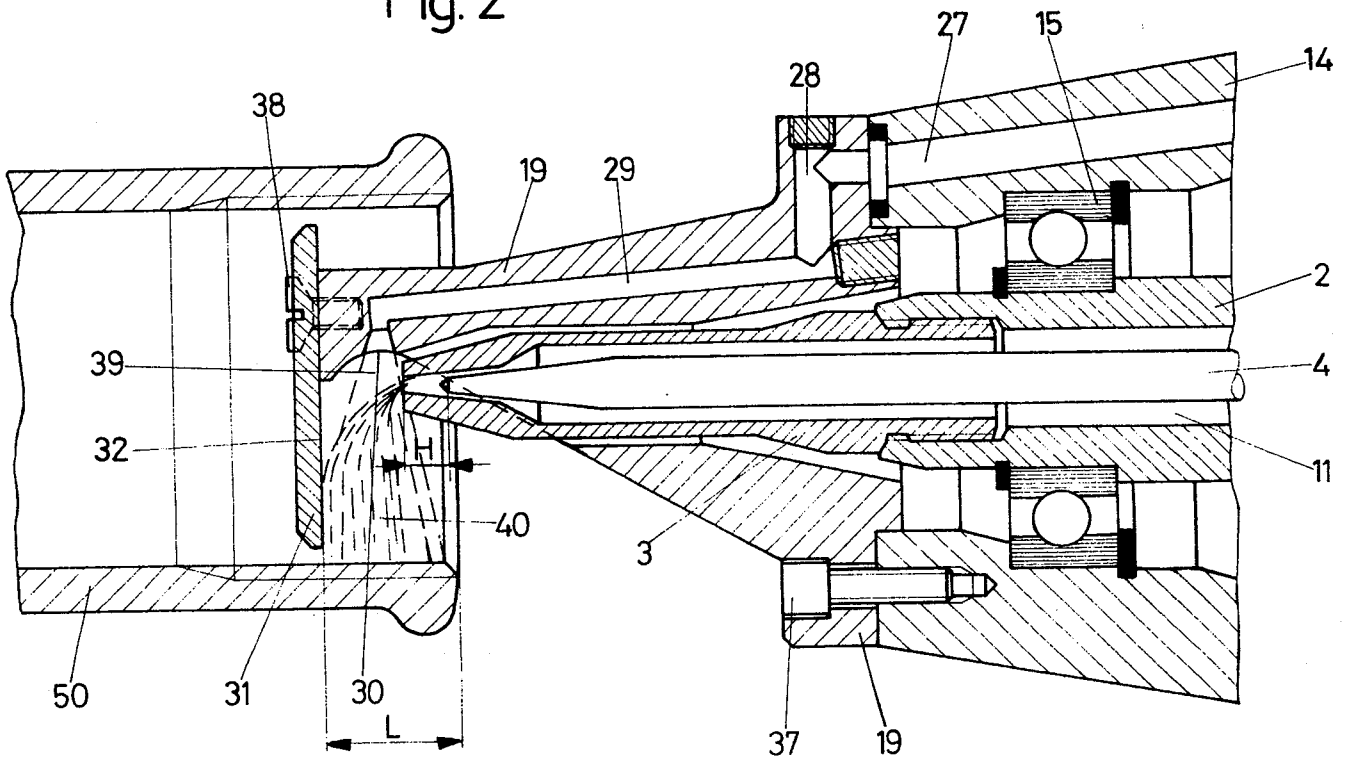
FIG. 2 is a detail view of a portion of FIG. 1 on a larger scale.

The fixed-position feed system for the coating material (fixed, that is, with reference to the gun body) provides a high degree of operating reliability. In contrast to this fixed nature of the liquid feed system is the arrangement for feeding the compressed air that breaks up the liquid jet into a spray. A rotating shell 14 is mounted on grooved ball bearings 15 and 16 in the forward part of the gun body 2 so that it can revolve around the axis of the nozzle 3. The rotary shell 14 is driven by a belt pulley 17 around which a belt, preferably a toothed or chain belt 18 makes positive engagement with the pulley. The belt 18 is driven by a motor 33 carried on the carrier plate 1. On the forward end of the rotary shell 14 the air nozzle 19 is interchangeably mounted by screws 37 (see FIG. 2). The compressed air supply for the nozzle 19 is provided by a supply tube connection 20 to the flange 21 that is screwed onto the carrier plate 1. The air supply passes through the two bores 22 and 23 in the flange 21 into the annular groove 25 of the rotary shell 14, which is sealed off by the seals 24, and from this groove through the bores 26, 27, 28 and 29 into the discharge opening 30 of the air nozzle 19. The control of the air supply is effected by the magnetic valve 62 and is further adjusted by the valve 63 interposed in the air supply line to the valve 62 (see FIG. 3). The axis of the discharge opening 30 runs perpendicularly or approximately perpendicularly to the axis of the nozzle 3. A round plate 31 is mounted on the far side of the air nozzle 19 from the liquid nozzle 3, the plate 31 being parallel to the axis of the discharge opening 30 and preferably perpendicular to the axis of the nozzle 3. The outer diameter of the plate 31 is slightly smaller than the inner diameter of the work piece 50 to be inside-coated. The plate 31 and the air nozzle 19 can, as is clear from FIG. 1, be made in one piece or else the plate 31 can be interchangeably mounted (interchangeable with plates of other sizes) on the air nozzle 19 by screws 38 (see FIG. 2), an arrangement which is of advantage for the coating of a small number of work pieces with different inner diameters.

The flange 21 is provided with an electrical heater 35 in order to warm the coating material present in the annular cavity 11 of the gun body 2, so as to provide a value of viscosity of the coating material that is suitable for the operation.

If coating materials are used that in operation generate easily ignitable gases, it is desirable to provide a heat transfer medium such as oil for the heating of the flange 21 and to cause such heat transfer medium to flow through bores 36 (shown in dash-dot lines in FIG. 1) provided for the purpose in the flange 21. In such cases it is also desirable to use an air-driven motor for the drive motor 33 to reduce the danger of ignition.

The embodiment above described, instead of being hand-held, is preferably mounted by means of the carrier plate 1 on an advancing drive unit 42 arranged to bring the coating apparatus into and out of a fixed working position by means of a pneumatically actuated cylinder 43. The control of the air supply through the conduits 46 and 47 to the cylinder 43 is provided by the magnetic valve 64 (see FIG. 3). For coating longer work piece portions it is also possible to provide an adjustable movement of the work.

It should also be noted as FIG. 1 shows the end of a work piece 50, for example a fitting with an inner thread 51, that is coated by means of the apparatus, for example on a lathe table such as is used for cutting threads. The axis of the internal threads 51 that are to be coated is set to be collinear with the axis of the nozzle 3, which is at the same time the axis of rotation of the air nozzle 19, so that the starting position of the apparatus with its steady nozzle 3 and its already rotating air nozzle 19 is in front of the work piece 50. The drive of the air nozzle 19 affixed to the rotary shell 14 is produced by the drive motor 33 operating through the pulleys 17 and 34 and the belt 18.

Activation of the advance mechanism 42 by its cylinder 43 then brings the coating apparatus into working position, i.e. it is advanced far enough in the axial direction for the inner surface 32 of the plate 31 to rotate at the beginning end of the length L (see FIG. 2) of the internal threads 51 that is to be coated in the work piece 50. At this time the air supply to the air nozzle 19 is started through the air lines already described by opening the magnetic valve 62 in the air supply line, so that a revolving air jet 39 (see FIG. 2) is produced that is directed perpendicular to the axis of rotation, which is also the axis of the nozzle 3. A short time thereafter, by operating the piston 6 with compressed air, the nozzle control needle 4 is displaced in the axial direction to the rear against the adjustment spindle 8 that acts as a stop, thus freeing the opening of the nozzle 3 by withdrawing the point of the control needle 4. The coating material that is held under constant pressure in the annular cavity of the gun body 2 then squirts out axially from the nozzle 3 and is defected into the radial direction by the air jet, producing a rotating spray cone 40 (see FIG. 2). The opening time of the nozzle 3 is so selected that for the particular rotary speed set for the air nozzle 19 a uniform coating of the desired thickness is obtained on the circumference of the internal thread 51. The coating thickness is also subject to variation by the adjustable opening H (see FIG. 2) of the nozzle control needle 4. The closing of the nozzle 3 is produced by release of the air pressure on the piston 6 and the restoring force of the spring 7. Shortly thereafter the air supply to the air nozzle 19 is also shut off and the coating apparatus is drawn back into the standby position by the advancing unit 42. The drive motor runs continuously and with it the rotary shell 14 and the air nozzle 19. With the return of the coating apparatus into the standby position the coated work piece 50 may be removed, for example by turning of the work table 52, and a new work piece brought into operating position, which will then be coated in the manner already described.

The cyclically repeating operation described above by way of example can conveniently be controlled by a programmable switching system 53 (see FIG. 3) by which, for example, the coating time can be set by setting a timing circuit or a timing counter (i.e. an analog or a digital timing control, according to the type of control system used).

The formation of the spray cone 40 results automatically in a coating thickness that is non-uniform in the axial direction of the thread 51. The thickness increases from the beginning of the thread to the middle of the spray cone 40, then decreases somewhat, so that at the end the coating thickness is greater than at the beginning because at this location the spray cone 40 is cut off by the plate 31. Such a characteristic of the coating thickness, however, is desired in the case of fittings in order to facilitate introduction of a mating piece into the threads.

In order to obtain a uniform coating thickness in the axial direction also, the coating apparatus can be moved in the axial direction during coating by a continuously adjustable operating drive of the advancing unit. This is likewise necessary if longer portions of cylindrical or conical internal walls or internal threads are to be coated in more or less tubular articles, in which case, of course, the structure holding the air nozzle 19 and the liquid nozzle 3 must be built out to a corresponding length.

The coating of work pieces can also be carried out with the coating apparatus in fixed position, in which case the axial presentation and advance movements must be carried out by the work piece, which can be provided by a movable work piece table or a work piece carrier in which the work piece is clamped.

The apparatus here described makes possible a reliable mode of operation because of the simple nonrotating supply and nozzle for the liquid coating material. It is widely applicable at low tool cost and permits an efficient coating of the work pieces at minimum operating time consumption because of the ready adjustment of the speed of rotation of the air nozzle and also of a rate of supply of the coating material, the latter being readily adjusted by setting the length of the opening stroke of the nozzle control needle.

Although the invention has been described in detail with reference to a particular illustrative embodiment, it will be understood as it has already been mentioned in a number of respects, that variations are possible within the inventive concept.

We claim:

1. Apparatus for applying a coating material to the internal threads of a fitting or tube end to a predetermined axial depth, comprising:

a fixed nozzle (3) arranged for directing a jet of coating material along the axis of said internal threads;

a revolving air jet nozzle (19) having its discharge orifice (30) radially offset and in front of the discharge orifice of said fixed nozzle (3) and arranged to revolve while remaining directed approximately at right angles to the axis of said fixed nozzle;

means for supplying air to said revolvig nozzle (19);

means for supplying coating material to said fixed nozzle (3), and a spray cone limiting plate (31) mounted on the rotating end of the apparatus adjacent to said revolving air jet nozzle (19), whereby a spray cone of said coating material is projected onto said internal threads, so that the coating thickness increases with axial distance from the open end of the threads to a maximum thickness axial location and the coating is caused to be thicker at the inner end than at the outer end due to the limiting of the spray cone by said plate (31).

2. Apparatus as defined in claim 1, in which said spray-cone limiting plate (31) has the shape of a circular disk of which the outer diameter is slightly smaller than the inner diameter of the work piece (50) to be coated.

3. Apparatus as defined in claim 2, in which said spray-cone limiting plate is detachably mounted and for which a set of interchangeable spray-cone limiting plates of different diameter are provided.

* * * * *